US006427253B1

(12) United States Patent
Penny

(10) Patent No.: US 6,427,253 B1
(45) Date of Patent: Aug. 6, 2002

(54) PROTECTIVE HEADGEAR COMPRISING A HEADBAND AND A SEMI-RIGID SUPPORT TO PROTECT A BACK REGION OF A USER'S HEAD

(75) Inventor: Martin Penny, Whitestone, NY (US)

(73) Assignee: Jacqueline Penny, Whitestone, NY (US)

( * ) Notice: Subject to any disclaimer, the term of this patent is extended or adjusted under 35 U.S.C. 154(b) by 0 days.

(21) Appl. No.: 09/814,310

(22) Filed: Mar. 21, 2001

(51) Int. Cl.[7] ..... A42B 3/00
(52) U.S. Cl. ..... 2/412; 2/425
(58) Field of Search ..... 2/425, 410, 411, 2/412, 418, 171, DIG. 11, 209

(56) References Cited

U.S. PATENT DOCUMENTS 1,434,854 A * 11/1922 Stall ..... 2/171
2,546,842 A * 3/1951 Yealdhall ..... 21/425
2,768,380 A * 10/1956 Golomb ..... 2/420
2,996,724 A * 8/1961 Rose et al. ..... 2/171
3,087,166 A * 4/1963 Howard ..... 2/420
5,012,533 A * 5/1991 Raffler ..... 2/420
D343,927 S 2/1994 Hamdan
5,930,841 A * 8/1999 Lampe et al. ..... 2/411
5,963,989 A * 10/1999 Robertson ..... 2/171
6,266,826 B1 * 7/2001 Alfano ..... 2/411

* cited by examiner

*Primary Examiner*—Rodney M. Lindsey

(57) ABSTRACT

A protective headgear comprising a headband and two shield plates. In a back region, the headband and the shield plate extend down behind the user's ear towards a bottom region on a user's head. The shield plate has a bottom protective rim that is designed to cup underneath a user's skull to shield the base of the user's skull. In addition, both shield plates have a small gap between them so that they wrap around the user's head. Additional components can also be added to this headgear. For example, this headgear can also include a terry cloth in a front region to gather sweat or moisture from a user's forehead. In addition, two ear flaps can also be attached to the headgear to cover a user's ears. These earflaps are designed to keep the user warm in the winter. In addition, this headgear can be alternately opened and closed via a releaseable fastener such as a hook and loop fastener.

16 Claims, 6 Drawing Sheets

PROTECTIVE HEADGEAR COMPRISING A HEADBAND AND A SEMI-RIGID SUPPORT TO PROTECT A BACK REGION OF A USER'S HEAD

BACKGROUND OF THE INVENTION

Field of the Invention

The invention relates to a removable protective headgear that is designed as a headband having protective pieces attached. More particularly, this protective headgear provides protection for the back of a user's head. This headgear could be used for additional protection when rollerskating, bicycling, snowboarding, rollerblading or any other activity that would require additional head protection.

SUMMARY OF THE INVENTION

The invention relates to a removable protective headgear in the form of a headband having semi-rigid or even rigid protective pieces attached. These semi-rigid or rigid plates can be attached to or detached from the headgear. These plates can be made out of plastic or a substantially rigid rubber composite. In addition, these plates can be applied to this headband either as an insert or as an outer attachment.

For example, if the plates are applied as an insert, then these plates are designed to insert between two sheets of the headband and then be fastened in via a top flap. These plates can also be fastened to the back of the headband via a hook and loop fastener, a tongue and groove connection, glue, or sewn on for a more permanent attachment or any other fastening means known in the art.

Both the headband and the plates are shaped so that the headgear extends above both of the user's ears so that in warmer months, the user can hear any surrounding noise. The user can also attach ear pieces to the headband so that in colder months, the headband covers the user's ears.

The headband is essentially made from a flexible elastic material such as neoprene rubber, or fleece with an elastic headband attached inside. This headband could also be covered with a hook and loop fastener friendly material comprising a mesh of fine loops. In addition, the headband can be opened by detaching a hook and loop fastener strap which allows the headband to be opened and removed from a person's head.

With this design, the headband can be used for both warmth and protection of the individual.

BRIEF DESCRIPTION OF THE DRAWINGS

Other objects and features of the present invention will become apparent from the following detailed description considered in connection with the accompanying drawings which disclose several embodiments of the present invention. It should be understood, however, that the drawings are designed for the purpose of illustration only and not as a definition of the limits of the invention.

In the drawings wherein similar reference characters denote similar elements throughout the several views.

DETAILED DESCRIPTION OF THE PREFERRED EMBODIMENT

Figure 1:
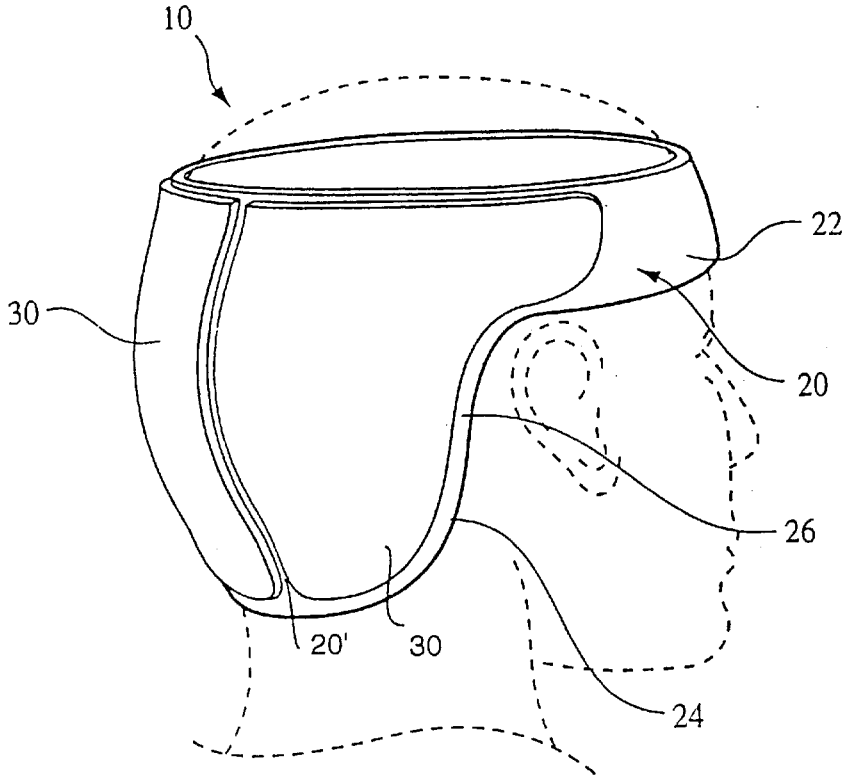
FIG. 1 is a perspective view of the first embodiment of the invention.

FIG. 1 refers to a perspective view of the first embodiment of the invention showing a headgear device 10 comprising a headband 20 and two supports 30. Supports 30 can be designed as either semi-rigid or substantially rigid depending on the type of protection desired by the user. Headband 20 contains a front section 22 and a back section 24. Connecting front section 22 and back section 24 is an angled mid section 26. Front section 22 is designed to wrap around a user's forehead while still allowing the user visibility. Thus, front section 22 is designed to have a smaller cross sectional area than back section 24.

Back section 24 is designed to hold supports 30 either permanently or in a removable manner with a small gap 20' between both supports 30. Back section 24 has a larger surface area than front section 22 and substantially covers a back region on a user's head. With this design, back section 24 provides coverage and protection for a back region of a user's head.

Angled mid section 26 is designed to connect front section 22 with back section 24. When headband 20 is placed on a user's head, angled mid section 26 slopes down between front section 22 and back section 24 wherein angled mid section 26 is angled above a user's ears to allow a user to hear the surrounding noise.

Figure 2:
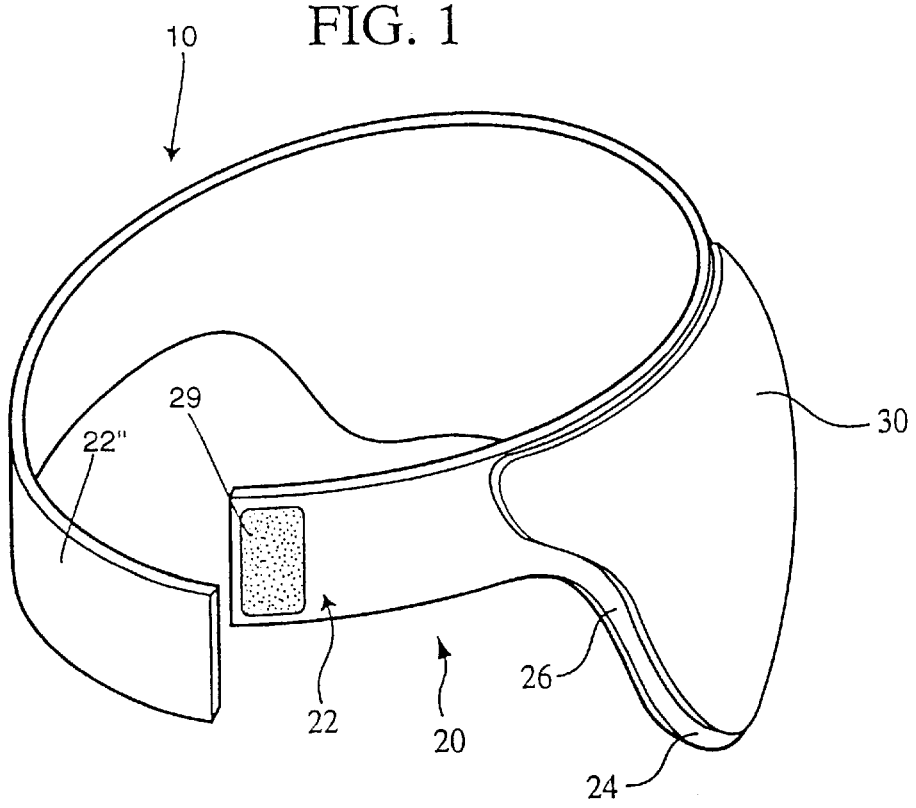
FIG. 2 is a perspective view of the second embodiment of the invention.

FIG. 2 shows a second embodiment of the invention wherein headband 20 is designed as an open headband having a fastener 29 such as a hook and loop fastener for attaching two portions 22' and 22" together in front section 22. With this design, front region 22 can be alternately opened and closed around a user's head so that headband 20 can be easily wrapped around a user's head.

Figure 3:
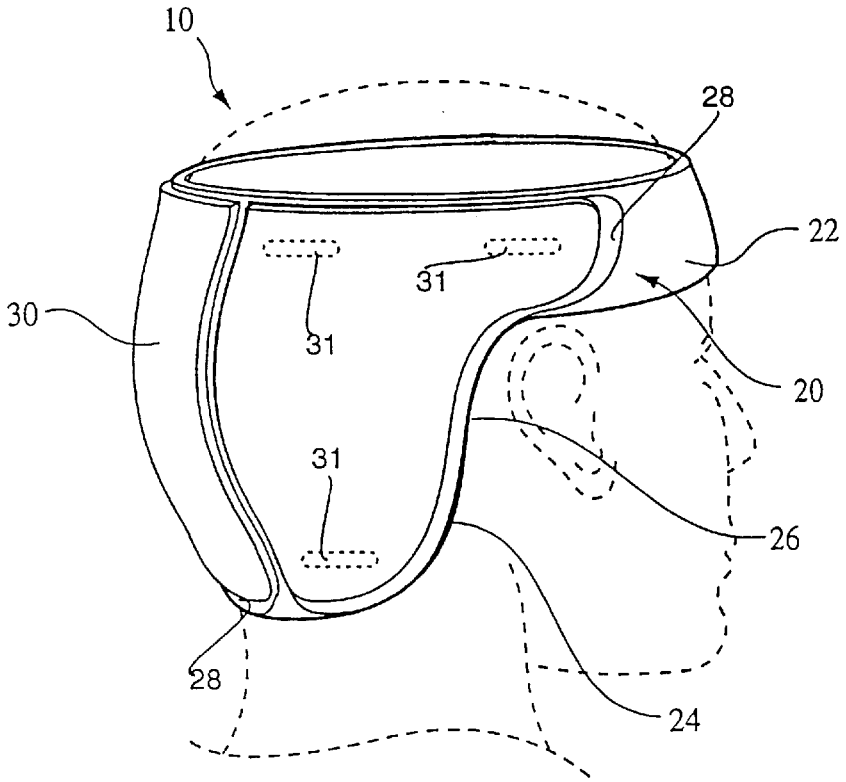
FIG. 3 is a perspective view of another embodiment of the invention showing an additional headpiece and a support which can be removed from the headgear.
Figure 4:
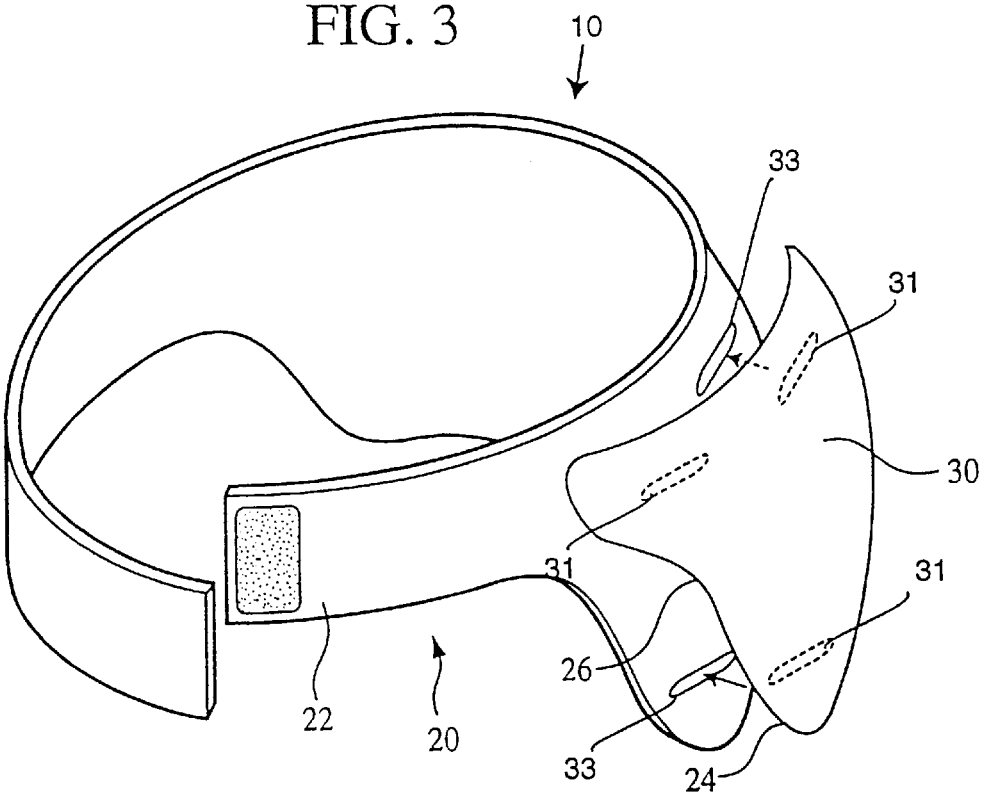
FIG. 4 is a perspective side view of another embodiment of the headgear having a removable support.

FIG. 3 shows a perspective view of another embodiment of device 10. With this design, an additional headpiece 28 can be added, wherein this headpiece 28 is shaped similar to supports 30 but this headpiece is made from the same or similar material to the headband. Headpiece 28 is disposed underneath supports 30 and provides additional padding for the user. In addition, FIG. 3 also shows supports 30 that can be attached to, or removed from headband 20 via fasteners 31. Fasteners 31 are disposed on a top region and on a bottom region on supports 30 so that they fully secure supports 30 to headband 20. As shown in FIG. 4, fasteners 31 on supports 30 fasten to fasteners 33 disposed on headband 20 wherein fasteners 31 and 33 can combine to form a hook and loop fastener, snaps, a tongue and groove connection, or any other type fastening means known in the art. Thus these fasteners allow supports to be alternately attached to headband 20 or detached from headband 20 so that headband 20 can be washed without damaging supports 30.

Supports 30 attach to an outer face of headband 20 primarily in back region 24. Supports 30 can be designed from a semi-rigid plastic, composite or metal-based material that is sufficiently rigid to displace energy related to a sharp contact or blow to the user's head resulting from a fall.

Supports 30 are placed on headband 20 so that when a user's head contacts an object resulting from a fall, the pressure or energy created from impact affects a substantially larger portion of the user's head but with a much lower force per surface area with the result probably being less injury.

Figure 5A:
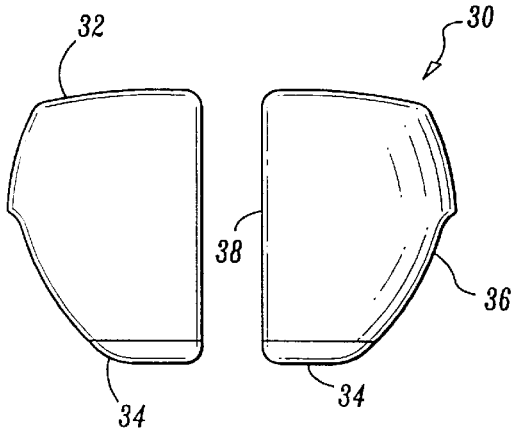
FIG. 5A is a back view of the support.
Figure 5B:
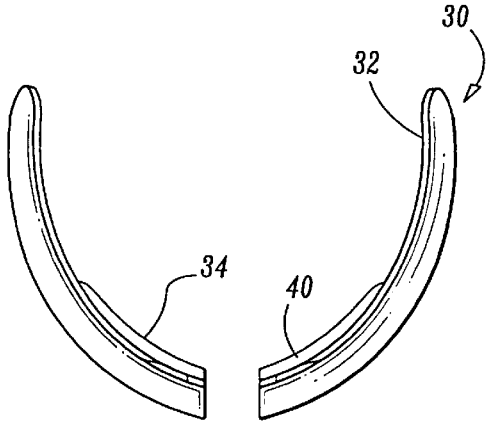
FIG. 5B is a top view of the support.
Figure 6A:
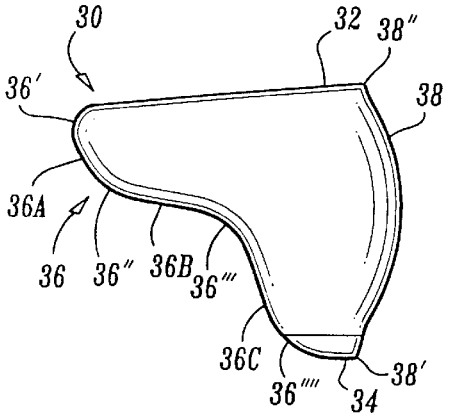
FIG. 6A is a side view of the support.

Supports 30 are shown in FIGS. 5A, 5B, 6A, and 6B. As shown in FIG. 5A, these supports are bounded by top and bottom edges 32 and 34 and two rounded side edges 36 and 38 respectively. Top and bottom edges 32 and 34 are substantially flat, while rounded side edge 36 is shaped in a curved manner so as to bend behind a user's ear. As shown in FIG. 6A, rounded side edge 36 has a first region 36*a*, that starts with a first curve 36' causing first region 36*a* to extend down to cover a portion of a user's head above the user's ear. This first region extends to a second curve 36", wherein edge 36 curves to a second region 36*b* that is shaped to extend above and back behind the user's ear. Second region 36*b* ends at a third curve 36'" wherein side edge 36 curves down to third region 36*c* that is designed to extend down to cover a substantial portion of a user's head. At this point, third region 36*c* reaches a fourth curve 36"" whereby rounded side edge 36 curves to form bottom edge 34.

Bottom edge 34 extends to curve 38' wherein at this point, rounded side edge 38 begins. Rounded side edge 38 extends up to curve 38" whereby at this point support 30 curves to form top edge 32. Rounded side edge 38 is essentially shaped convex, so that it bows out to protect a larger portion of a user's head.

Figure 6B:
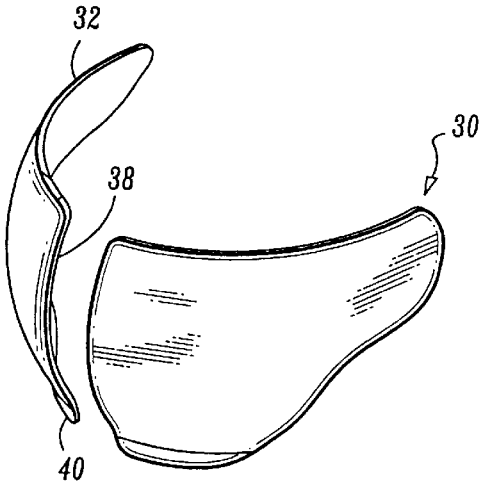
FIG. 6B is a perspective view of the support.

As shown in FIGS. 6A and 6B, rounded side edge 38 is designed to be curved so that support 30 can wrap around and underneath a user's head and flare out forming a protective rim 40. With this design, support 30 is essentially designed to wrap around and underneath the user's head to protect the user's head. Protective rim 40 (See also FIG. 5B) extends along the base of the user's skull so that the user's head receives protection over a substantial portion of the head.

Essentially device 10 comprising headband 20, and support pieces 30 is particularly designed to protect a user's head while still allowing sufficient size and shape adjustability for a user. For example, supports 30 are curved in region 36B to curve above a user's ears. In addition, supports 30 are also curved in region 36C to curve down and protect a base region of a user's skull. Rounded side edge 38 is also curved so that it cups around a user's head and extends underneath a base region in the user's skull via protective rim 40. While a single solid support may be used to protection an entire back region of a user's head, in a preferred embodiment, two supports 30 are used so that there is a gap or a mid region 20' allowing headgear 10 some adjustability when securing to the user's head.

Figure 7:
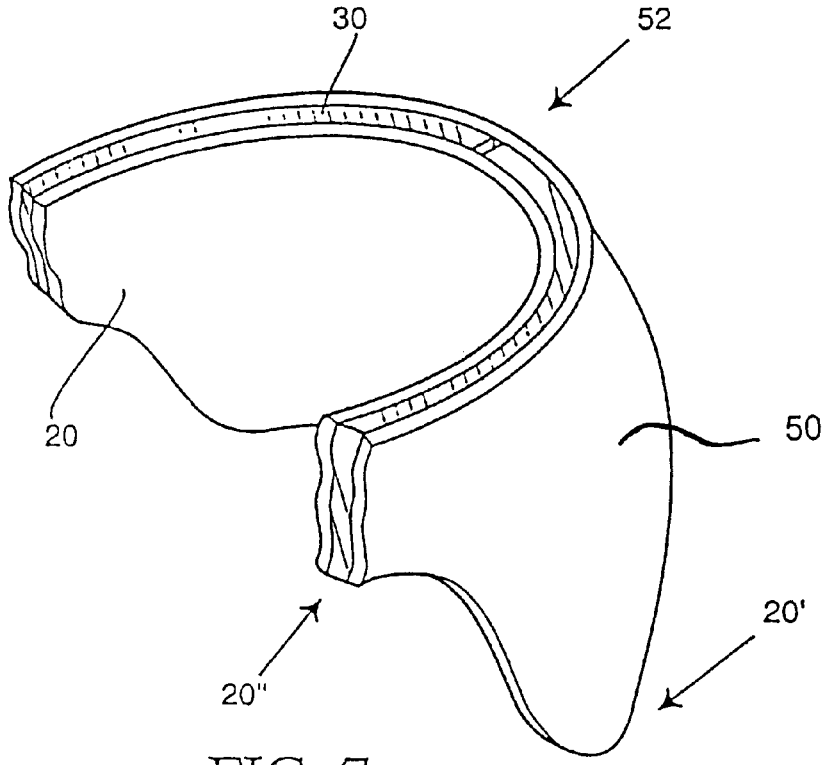
FIG. 7 is a perspective view of a portion of the fourth embodiment of the invention.

FIG. 7 is a side perspective view of another embodiment of the invention. In this view, supports 30 are sandwiched between headband 20 and an additional cover 50. Headband 20 and additional cover 50 define a pocket 52 wherein pocket 52 is designed to hold supports 30 therein. Additional cover 50 is integrally attached to headband 20 at a bottom region 20' and on a side region not shown.

Figure 8:
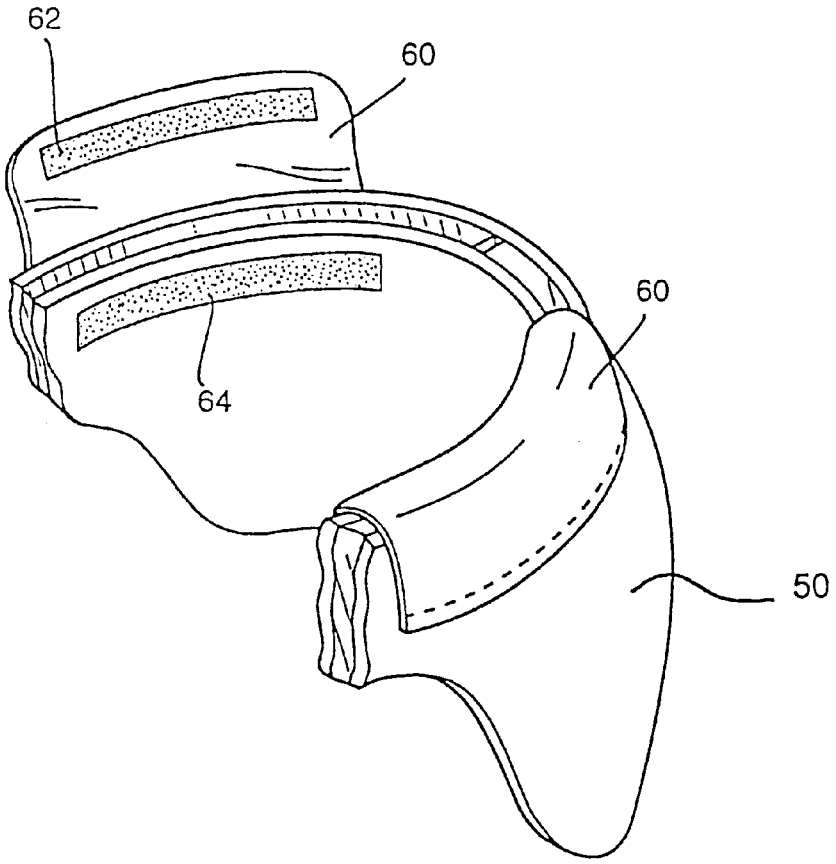
FIG. 8 is a perspective view of a portion of the fourth embodiment of the invention having flaps.

In addition, as shown in FIG. 8 there is also an additional flap 60 that is attached to additional cover 50. Additional flap 60 is designed so that it has a fastener 62 that allows additional flap 60 to fold over and secure onto fastener 64 on headband 20. Essentially, additional flap 60 is divided into two pieces so that a first, piece of additional flap 60 does not interfere with adjacent piece of flap 60 as it is being folded over. Fasteners 62 and 64 can combine to be a hook and loop fastener, snaps, a tongue and groove connection or any other type fastener known in the art.

Figure 9:
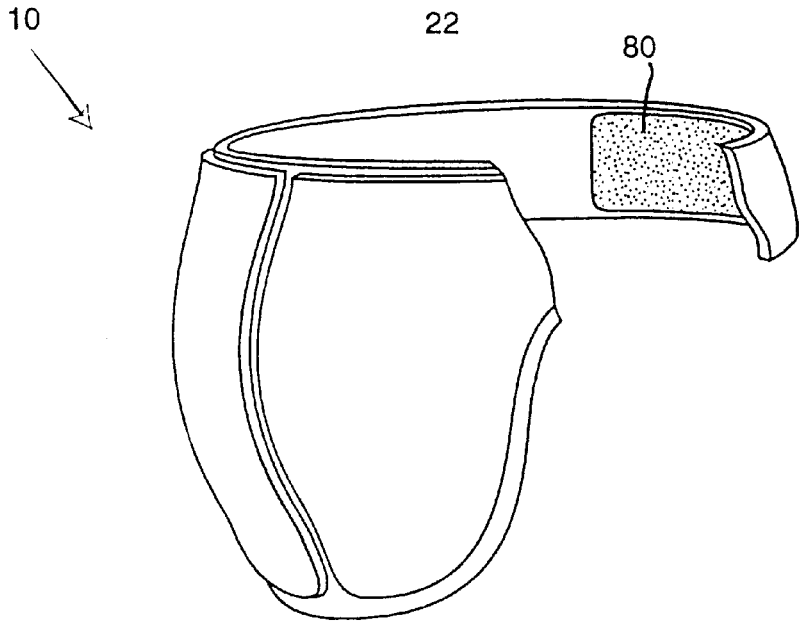
FIG. 9 is a perspective view of the headband having an additional terry cloth attached.

Additional components can also be added to this device. For example as shown in FIG. 9 a terry cloth piece 80 can be added to headband 20 at front region 22. Terry cloth piece 80 is designed to absorb sweat from a user and to also provide a roughened surface on headband 20 so that it remains stable on the user's forehead.

Figure 10:
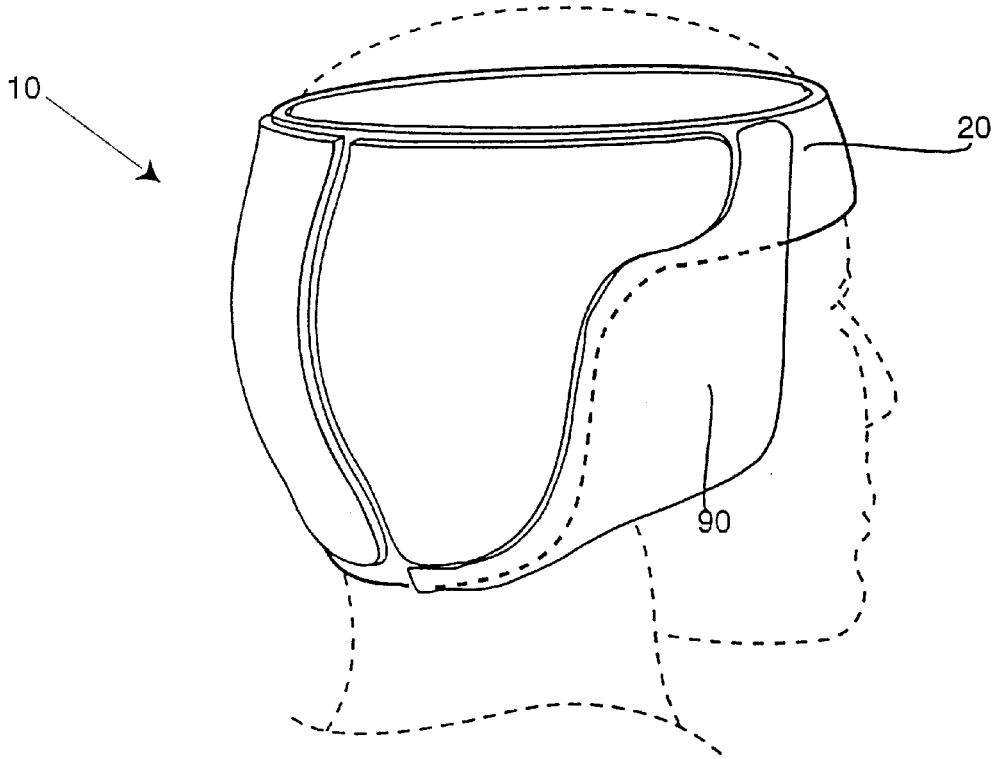
FIG. 10 is a perspective view of the invention showing additional ear flaps.
Figure 11:
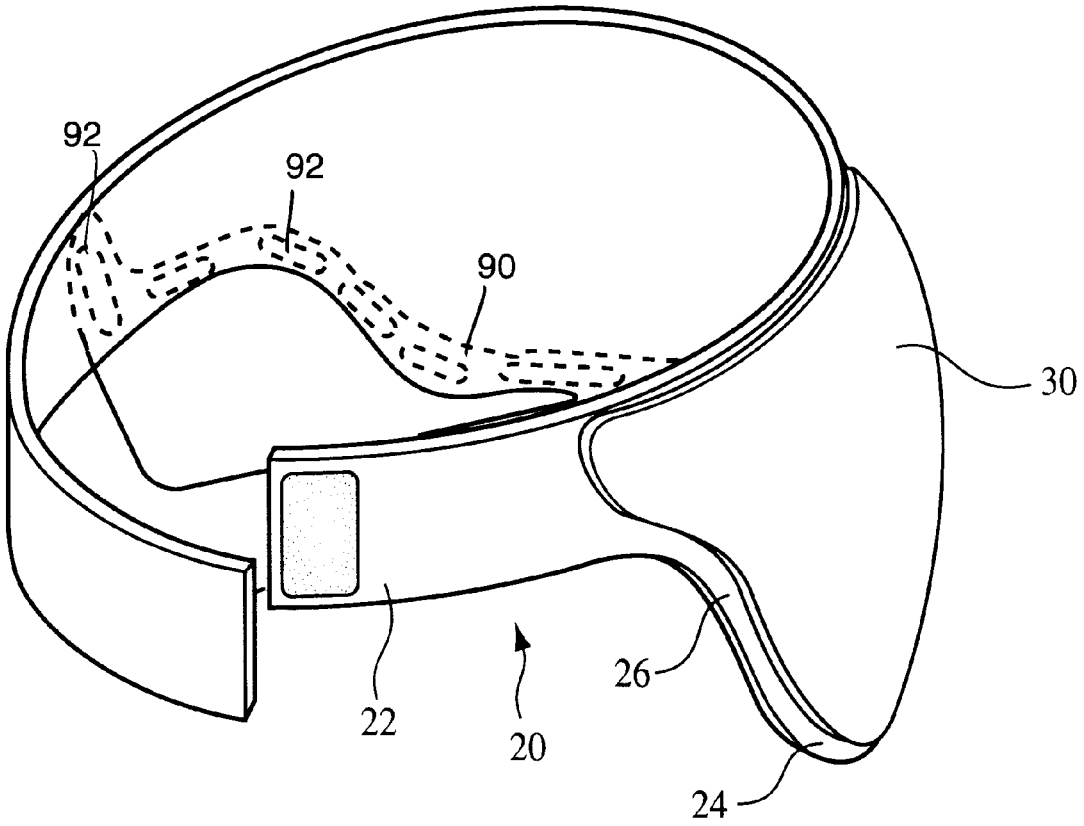
FIG. 11 is a perspective view of the invention showing the ear flaps as they attach to the headband.

FIG. 10 shows one of two additional ear pieces 90 can also be added to this device. Additional ear piece 90 is designed to attach to an outside region of headband 20 and cover a user's ears. As shown in FIG. 11, additional ear piece 90 can be attached to an outside region of headband 20 via fasteners 92 extending at different angles along the ear piece. Fasteners 92 could be a hook and loop fastener, or any other type fastener known in the art. With this design, once ear piece 90 is attached, it remains secure along an outside rim of headband 20 adjacent to supports 30 because it is fixed by fasteners 92. Additional ear piece 90 is designed to provide additional warmth to a user during colder periods giving this protective headgear additional use across all seasons.

Accordingly, while several embodiments of the present invention have been shown and described, it is to be understood that many changes and modifications may be made thereunto without departing from the spirit and scope of the invention as defined in the appended claims.

What is claimed is:

1. A protective headgear device comprising:

a headband for extending around a user's head from a front region on said user's head to a back region on said user's head, wherein said headband comprises three different portions, a front portion for covering said front region of the user's head, a back portion for covering said back region of the user's head, and an expanding sloped portion for joining said front portion with said back portion, wherein said back portion is designed to cover a larger area of the user's head than said front portion; and at least one semi-rigid support coupled to said headband at a position wherein said semi-rigid support protects said back region on said user's head, wherein said at least one semi-rigid support has a curved rim region for curving around a base region of said user's head to protect said base region on said user's head.

2. The protective headgear device as in claim 1, further comprising a pocket for receiving said supports therein, said pocket being disposed at said back portion on said headband.

3. The protective headgear device as in claim 1, wherein said at least one semi-rigid support is made from plastic.

4. The protective headgear device as in claim 1, wherein said at least one semi-rigid support further comprises a releasable fastener for releasably fastening said at least one semi-rigid support to said headband.

5. The protective headgear device as in claim 1, wherein said at least one semi-rigid support is securely fastened to said headband.

6. The protective headgear device as in claim 1, further comprising an absorbent insert coupled to an inside surface of said front portion of said headband so that said headband absorbs sweat from the user.

7. The protective headgear device as in claim 1, wherein said headband is made from a flexible material to adjust to a size and shape of said user's head.

8. The protective headgear device as in claim 1, wherein said headband further comprises a releasable fastener for allowing said headband to be opened to allow a user to put the headband on, or closed, closing the headband around the user's head.

9. The protective headgear device as in claim 8, wherein said releasable fastener is a hook and loop fastener.

10. The protective headgear device as in claim 9, wherein said releasable fastener is disposed at said front portion of said headband.

11. The protective headgear device as in claim 1, further comprising at least one ear piece formed by a flap coupled to said headband, said at least one ear piece extending over the user's ears so that said additional flap provides warmth to the user's ears.

12. A protective headgear device comprising:

a headband having an inner surface and an outer surface for extending from a front portion of a user's head to a back portion of said user's head; and a least two rigid supports coupled to said outer surface of said headband protecting said back portion of said user's head, wherein said at least two rigid supports are spaced apart from each other on said headband allowing said headband to stretch or bend to conform to a user's head, and wherein said at least two rigid supports are releasably attached to said headband via at least one fastener.

13. The device as in claim 12, wherein said fastener is a hook and loop fastener.

14. The device as in claim 12, further comprising an additional cover attached to said headband, wherein said headband and said additional cover define at least one pocket having an opening designed to receive at least one of said at least two rigid supports.

15. The device as in claim 14, further comprising an additional flap, wherein said additional flap is connected to said headband and is designed to cover said opening in said pocket.

16. A protective headgear device comprising:

a headband for extending around a user's head from a front region on said user's head to a back region on said user's head;

an additional headpiece attached to said headband and forming a pad for additional protection of said user's head; and at least one semi-rigid support coupled to said headband and said headpiece at a position wherein said semi-rigid support protects said back region on said user's head.

* * * * *